US010690093B2

(12) United States Patent
Sakamoto

(10) Patent No.: US 10,690,093 B2
(45) Date of Patent: Jun. 23, 2020

(54) INTERNAL COMBUSTION ENGINE

(71) Applicant: TOYOTA JIDOSHA KABUSHIKI KAISHA, Aichi-ken (JP)

(72) Inventor: Hironobu Sakamoto, Toyota (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/224,799

(22) Filed: Dec. 19, 2018

(65) Prior Publication Data

US 2019/0211780 A1 Jul. 11, 2019

(30) Foreign Application Priority Data

Jan. 10, 2018 (JP) ..... 2018-002044

(51) Int. Cl.

| | |
|---|---|
| ***F02F 1/36*** | (2006.01) |
| ***F02M 26/28*** | (2016.01) |
| ***F02M 26/41*** | (2016.01) |
| ***F02F 1/14*** | (2006.01) |
| ***F01P 3/02*** | (2006.01) |
| ***F02M 26/30*** | (2016.01) |

(52) U.S. Cl.

CPC ..... *F02M 26/28* (2016.02); *F01P 3/02* (2013.01); *F02F 1/14* (2013.01); *F02M 26/30* (2016.02); *F02M 26/41* (2016.02); *F01P 2003/028* (2013.01)

(58) Field of Classification Search

CPC .. F01P 3/02; F01P 2003/027; F01P 2003/028; F02F 1/40

USPC .... 123/40.01, 40.02, 14.17, 41.82 R, 741.83

See application file for complete search history.

(56) References Cited

U.S. PATENT DOCUMENTS 5,615,641 A * 4/1997 Koch ..... F02F 1/40 123/41.82 R
5,890,461 A * 4/1999 Iikura ..... F01P 3/14 123/41.82 R
8,887,674 B2 * 11/2014 Brandl ..... F02F 1/242 123/41.31

(Continued)

FOREIGN PATENT DOCUMENTS

| | | |
|---|---|---|
| JP | 2008-45498 A | 2/2008 |
| JP | 2013-83206 A | 5/2013 |
| JP | 2014-84741 A | 5/2014 |

*Primary Examiner* — John Kwon
(74) *Attorney, Agent, or Firm* — Hauptman Ham, LLP

(57) ABSTRACT

An internal combustion engine includes a cylinder block, a cylinder-block passage, a cylinder head, a cylinder-head passage, cylinders, an introducing portion, a restricting wall, and communicating portions. The introducing portion is configured to introduce coolant flowing in the cylinder-head passage into an EGR cooler. The restricting wall is configured to restrict flow of the coolant from a section corresponding to the spark plug toward the introducing portion. The communicating portions cause the cylinder-block passage and the cylinder-head passage to communicate with each other. A direction perpendicular to both the extending direction of the central axis of each cylinder and the cylinder arrangement direction is defined as a predetermined direction. Certain one or certain ones of the communicating portions are arranged at positions closer to an intake manifold than the restricting wall in the predetermined direction.

6 Claims, 3 Drawing Sheets

(56) References Cited

U.S. PATENT DOCUMENTS

| | | | | |
|---|---|---|---|---|
| 2005/0172917 | A1* | 8/2005 | Betsch | F02F 1/40 123/41.82 R |
| 2005/0193966 | A1* | 9/2005 | Mac Vicar | F01P 3/02 123/41.82 R |
| 2005/0205024 | A1* | 9/2005 | Yamada | F02F 1/38 123/41.82 R |
| 2005/0229875 | A1* | 10/2005 | Maassen | F02F 1/40 123/41.82 R |
| 2011/0226198 | A1* | 9/2011 | Maruyama | F02F 1/40 123/41.82 R |
| 2016/0102595 | A1* | 4/2016 | Nagai | F02M 35/10091 123/41.82 R |
| 2017/0254298 | A1* | 9/2017 | Beyer | F02M 26/30 |
| 2017/0276095 | A1* | 9/2017 | Beyer | F02M 26/30 |
| 2018/0030880 | A1* | 2/2018 | Takizawa | F01P 7/16 |

* cited by examiner

INTERNAL COMBUSTION ENGINE

RELATED APPLICATIONS

The present application claims priority of Japanese Application Number 2018-002044, filed on Jan. 10, 2018, the disclosure of which is hereby incorporated by reference herein in its entirety.

BACKGROUND

1. Field

The following description relates to an internal combustion engine that introduces coolant from inside the cylinder head to an exhaust gas recirculation (EGR) cooler.

2. Description of Related Art

Japanese Laid-Open Patent Publication No. 2013-83206 describes an example of internal combustion engines including an EGR cooler. In a typical internal combustion engine including an EGR cooler, coolant circulates in the cylinder block and then flows into the cylinder head. The coolant then circulates in the cylinder head before being introduced into the EGR cooler.

In the cylinder head, the section in the vicinity of a spark plug is located immediately above a combustion chamber. Some of the coolant circulating in the cylinder head flows through the vicinity of the spark plug and is thus more likely to receive heat generated in the combustion chamber than the coolant flowing in a zone set apart from the spark plug. That is, the temperature of the coolant that has flowed through the vicinity of the spark plug tends to be high. If such high-temperature coolant is introduced into the EGR cooler, the cooling efficiency of EGR gas used in the EGR cooler is lowered.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In accordance with one aspect of the disclosure, an internal combustion engine is provided that includes a cylinder block, a cylinder-block passage provided in the cylinder block, a cylinder head, a cylinder-head passage, cylinders, an introducing portion, a restricting wall, and communicating portions. The cylinder-head passage is provided in the cylinder head and configured such that coolant flows into the cylinder-head passage after circulating in the cylinder-block passage. The cylinders are arranged side-by-side in the cylinder block. A direction in which the cylinders are arranged side-by-side is a cylinder arrangement direction. The introducing portion is provided at an end of the cylinder head in the cylinder arrangement direction and configured to introduce the coolant flowing in the cylinder-head passage into an EGR cooler. One of the cylinders closest to the introducing portion in the cylinder arrangement direction is a predetermined cylinder. The restricting wall is provided between a spark plug provided for the predetermined cylinder and the introducing portion in the cylinder-head passage and is configured to restrict flow of the coolant from a section corresponding to the spark plug toward the introducing portion. Communicating portions arranged at corresponding positions in a flow direction of the coolant in the cylinder-block passage to cause the cylinder-block passage and the cylinder-head passage to communicate with each other. A direction perpendicular to both an extending direction of a central axis of each of the cylinders and the cylinder arrangement direction is a predetermined direction. A certain one or certain ones of the communicating portions are arranged at positions closer to an intake manifold than the restricting wall in the predetermined direction.

In the above-described configuration, coolant flows from the cylinder-block passage into the cylinder-head passage via the certain one(s) of the communicating portions. The restricting wall limits the flow toward the introducing portion of the comparatively high-temperature coolant that has flowed through the vicinity of the spark plug in the cylinder-head passage. This facilitates the flow to the introducing portion of the coolant that has flowed into the cylinder-head passage via the certain one(s) of the communicating portions. The coolant that has flowed into the cylinder-head passage via the certain one(s) of the communicating portions thus does not flow in the vicinity of the spark plug. This limits the temperature rise of the coolant, thus limiting the reduction of the cooling efficiency of EGR gas by the EGR cooler.

In the above-described engine, the restricting wall may be set apart from an intake-port separating wall, which is a separating wall that separates a predetermined intake port and the cylinder-head passage from each other. Specifically, the predetermined intake port refers to one of the intake ports arranged in the cylinder head that is located closest to the introducing portion in the cylinder arrangement direction.

In the above-described configuration, some of the comparatively low-temperature coolant that has flowed from the cylinder-block passage into the cylinder-head passage via the certain one(s) of the communicating portions flows to the vicinity of the spark plug via the clearance between the intake-port separating wall and the restricting wall. This may improve the cooling efficiency of the combustion chamber as compared to a case in which the comparatively low-temperature coolant does not flow to the vicinity of the spark plug.

There may be a great distance from the certain one(s) of the communicating portions to the introducing portion. In this case, the coolant that has flowed into the cylinder-head passage via the certain one(s) of the communicating portions tends to receive a great amount of heat by the time the coolant reaches the introducing portion. That is, the greater the distance from the certain one(s) of the communicating portions to the introducing portion, the higher the temperature of the coolant introduced into the EGR cooler tends to be. Therefore, in the above-described engine, the introducing portion may be formed at a position closer to the intake manifold than the restricting wall in the predetermined direction. In this configuration, the distance from the certain one(s) of the communicating portions to the introducing portion is relatively small. The coolant that has flowed into the cylinder-head passage via the certain one(s) of the communicating portions receives a correspondingly small amount of heat by the time the coolant reaches the introducing portion. This limits the temperature rise of the coolant that is introduced into the EGR cooler.

A section of the cylinder head closer to the introducing portion than the restricting wall in the cylinder arrangement direction is a first end. The engine further includes an EGR passage section and a passage separating wall. The EGR passage section is arranged in the first end section of the cylinder head and configured such that EGR gas flows toward the EGR cooler through the EGR passage section. The passage separating wall is arranged in a section of the cylinder head closer to an exhaust manifold than the introducing portion in the predetermined direction. The passage separating wall is a separating wall that separates the cylinder-head passage and the EGR passage section from each other.

In the above-described configuration, the coolant flowing in the vicinity of the passage separating wall, which separates the cylinder-head passage and the EGR passage section from each other, in the cylinder-head passage cools the EGR gas that flows in the EGR passage section. That is, since the EGR gas flows in the cylinder head, the temperature of the EGR gas is lowered to a certain extent by the time the EGR gas flows into the EGR cooler. As a result, the temperature of the EGR gas that flows out of the EGR cooler becomes further lowered.

If the distance from the certain one(s) of the communicating portions to the passage separating wall is great, the comparatively low-temperature coolant, which has flowed into the cylinder-head passage via the certain one(s) of the communicating portions are less likely to reach the vicinity of the passage separating wall. This hampers a coolant flow in the vicinity of the passage separating wall, thus reducing the cooling efficiency of the EGR gas that flows in the EGR passage section.

Thus, a passage restricting portion is preferably arranged in a section closer to the introducing portion than the restricting wall in the cylinder arrangement direction and between the introducing portion and the passage separating wall in the predetermined direction. The restricting portion is configured to decrease a width of the cylinder-head passage in the extending direction of the central axis of the corresponding cylinder.

In the above-described configuration, the passage restricting portion reduces the cross-sectional flow area of the corresponding section of the cylinder-head passage. The coolant that has flowed into the cylinder-head passage via the aforementioned certain one(s) of the communicating portions passes through this section while flowing toward the passage separating wall. This increases the flow velocity of the coolant and thus allows the coolant that has flowed into the cylinder-head passage via the aforementioned certain one(s) of the communicating portions to readily reach the vicinity of the passage separating wall. This ensures a coolant flow in the vicinity of the passage separating wall, thus limiting the reduction of the cooling efficiency of the EGR gas that flows in the EGR passage section.

For example, the passage restricting portion may be a projection projecting toward the cylinder block from a section of a peripheral wall of the cylinder-head passage located on a side opposite to the cylinder block.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Unless indicated otherwise, a statement that a first layer is "on" a second layer is to be interpreted as covering both a case where the first layer directly contacts the second layer and a case where one or more other layers are disposed between the first layer and the second layer or the substrate. Likewise, A statement that a feature is "connected to" another feature is interpreted as covering both a case where the feature is directly connected to the other feature, and a case where the feature is indirectly connected to the other feature.

An internal combustion engine 10 according to embodiments will now be described with reference to FIGS. 1 to 6.

Figure 1:
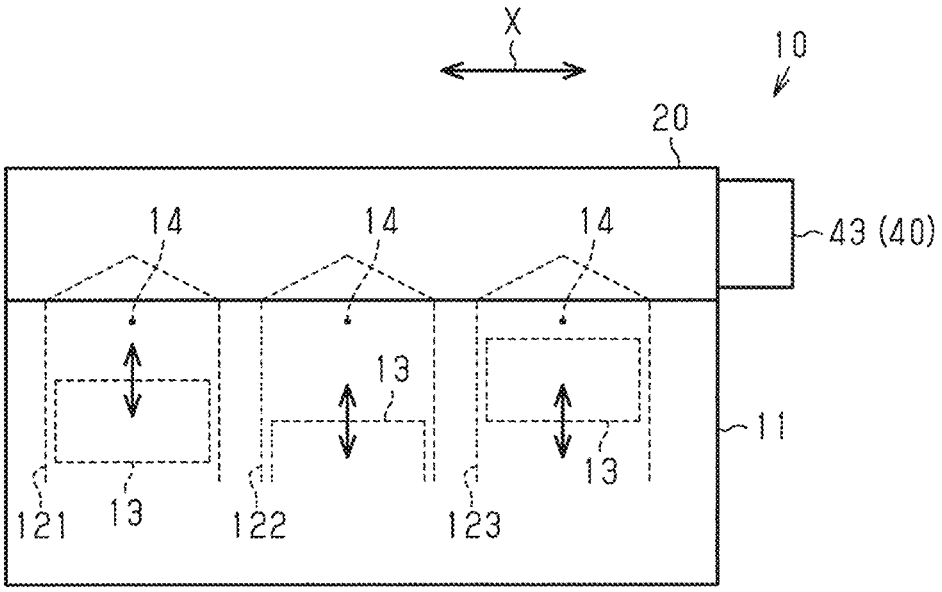
FIG. 1 is a schematic view representing the positional relationship among the cylinder block, the cylinder head, and the EGR cooler in an internal combustion engine.
Figure 2:
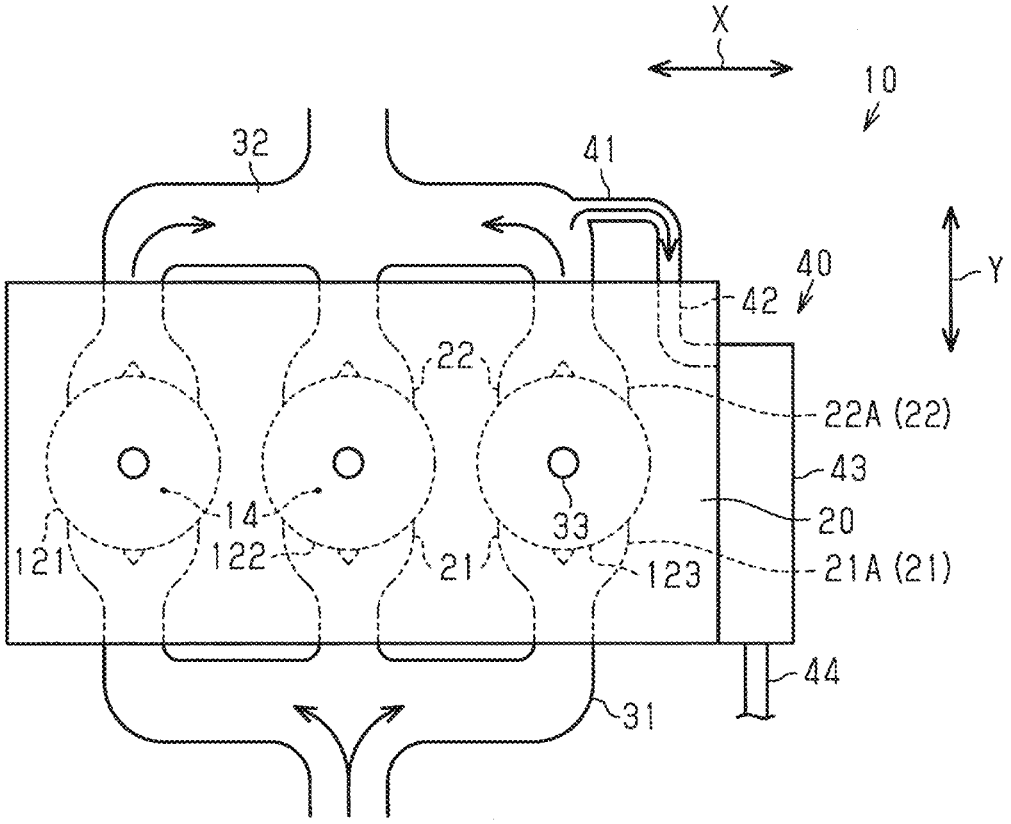
FIG. 2 is a schematic diagram representing the internal combustion engine of FIG. 1.

As illustrated in FIGS. 1 and 2, the internal combustion engine 10 includes a cylinder block 11 and a cylinder head 20. The cylinder head 20 is attached to the cylinder block 11. Multiple (for example, three, in FIGS. 1 and 2) cylinders 121, 122, 123 are provided in the cylinder block 11. As shown in FIGS. 1 and 2, the direction in which the cylinders 121, 122, 123 are arranged in the cylinder block 11 is defined as the cylinder arrangement direction X. Each of the cylinders 121, 122, 123 in the cylinder block 11, the cylinder head 20, and a corresponding piston 13 define a combustion chamber 14. The pistons 13 reciprocate in the corresponding cylinders 121, 122, 123 in the respective directions represented by arrows.

With reference to FIG. 2, an intake manifold 31 and an exhaust manifold 32 are connected to the cylinder head 20. Intake air flows through the intake manifold 31 and is then introduced into each of the combustion chambers 14 via a corresponding intake port 21, which is provided in the cylinder head 20. In each combustion chamber 14, a spark plug 33 ignites and burns air-fuel mixture, which contains intake air and fuel. The air-fuel mixture thus generates exhaust gas in the combustion chamber 14. Then, the exhaust gas is discharged into the exhaust manifold 32 via a corresponding exhaust port 22 provided in the cylinder head 20.

The engine 10 has an EGR device 40. The EGR device 40 recirculates the exhaust gas, as EGR gas, from inside the exhaust manifold 32 into an intake pipe. The term EGR stands for exhaust gas recirculation. The EGR device 40 has an upstream EGR passage 41, an in-cylinder-head EGR passage 42, an EGR cooler 43, and a downstream EGR passage 44. The upstream EGR passage 41 is connected to the exhaust manifold 32. The in-cylinder-head EGR passage 42 is connected to the upstream EGR passage 41 and provided in the cylinder head 20. The EGR cooler 43 is connected to the in-cylinder-head EGR passage 42 and configured to cool the EGR gas. The downstream EGR passage 44 is configured such that the EGR gas flows in the downstream EGR passage 44 after being cooled by the EGR cooler 43. In the present embodiment, the in-cylinder-head EGR passage 42 corresponds to the EGR passage section. The EGR passage section is the section in the cylinder head 20 in which the EGR gas flows.

As shown in FIGS. 1 and 2, the EGR cooler 43 is attached to an end of the cylinder head 20 in the cylinder arrangement direction X, that is, a first end of the cylinder head 20. That is, referring to FIG. 4, an introducing portion 55 is provided at the first end of the cylinder head 20 in the cylinder arrangement direction X. The introducing portion 55 introduces coolant from inside the cylinder head 20 into the EGR cooler 43. The cylinder 123 is located closest to the introducing portion 55 in the cylinder arrangement direction X among the cylinders 121, 122, 123, as illustrated in FIGS. 1 and 2, and thus corresponds to the predetermined cylinder.

Figure 3:
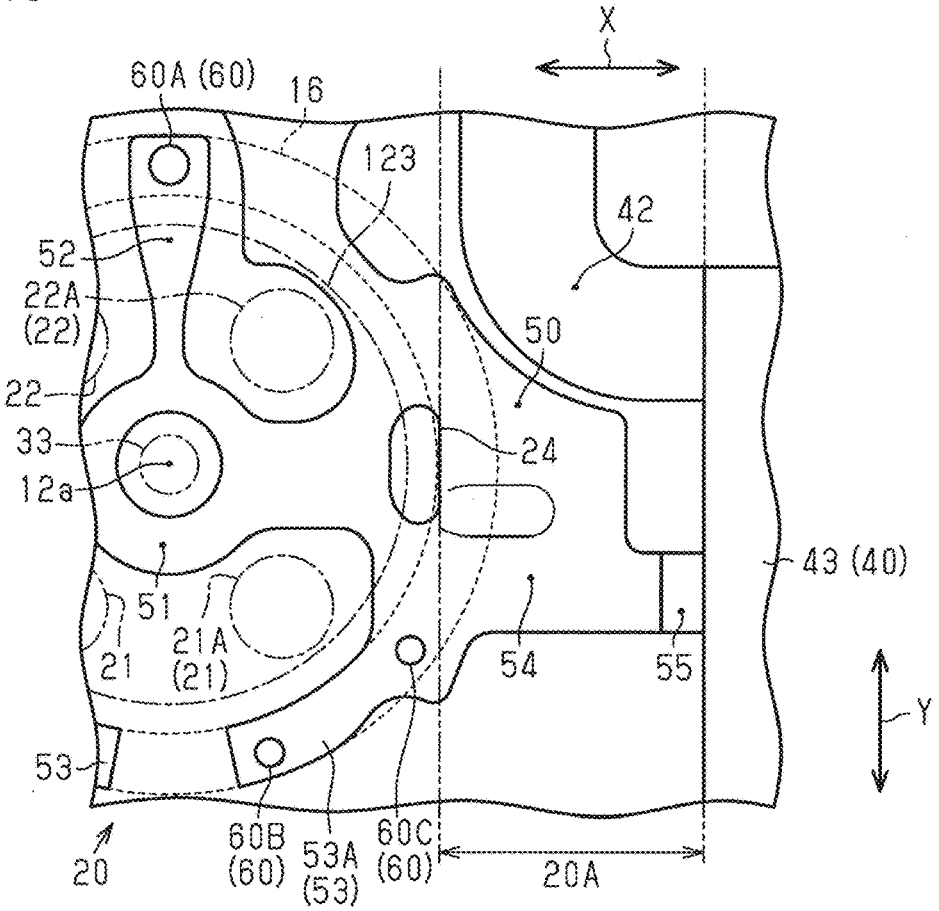
FIG. 3 is a diagram showing the configuration of a coolant passage in the cylinder head and a section of an EGR device.

FIG. 3 represents the positional relationship between a cylinder-block passage 16 and a cylinder-head passage 50. The cylinder-block passage 16 is a coolant passage in the cylinder block 11. The cylinder-head passage 50 is a coolant passage in the cylinder head 20. The cylinder-block passage 16 surrounds the cylinders 121, 122, 123, which are in the cylinder block 11, from outside. A gasket (not shown) is arranged between the cylinder block 11 and the cylinder head 20. Communicating portions 60 (60A, 60B, 60C) are provided at corresponding positions in the gasket in the flow direction of coolant in the cylinder-block passage 16. The communicating portions 60 causes the cylinder-block passage 16 and the cylinder-head passage 50 to communicate with each other. This arrangement causes the coolant flowing in the cylinder-block passage 16 to flow into the cylinder-head passage 50 via the communicating portions 60.

Figure 4:
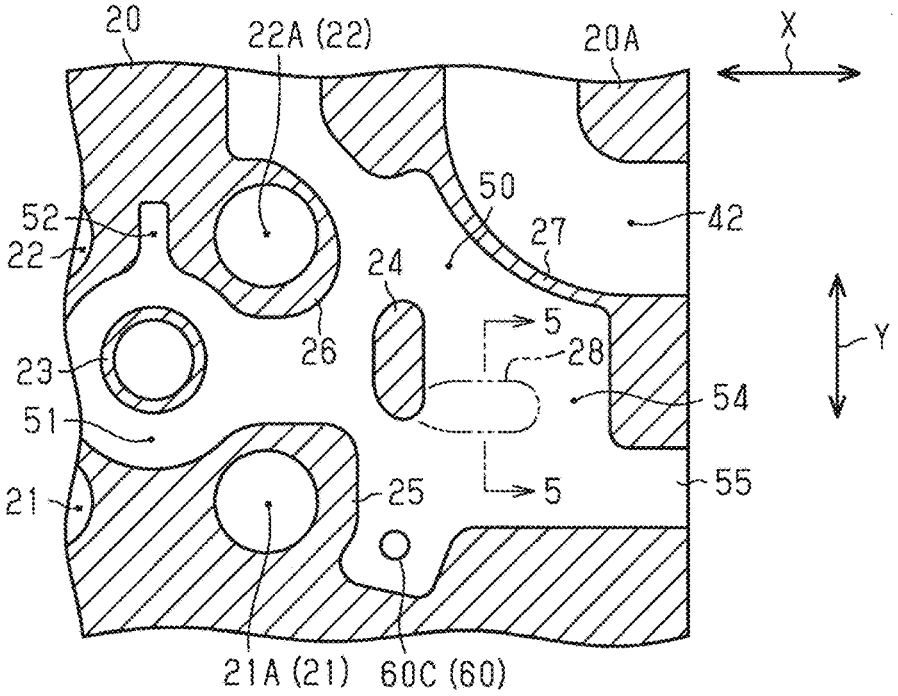
FIG. 4 is a cross-sectional view of the cylinder head.

As illustrated in FIGS. 3 and 4, a direction perpendicular to both the extending direction of a central axis 12*a* of the cylinder 123 and the cylinder arrangement direction X is defined as a predetermined direction Y. The introducing portion 55 is arranged at a position closer to the intake manifold 31 than the spark plug 33 in the predetermined direction Y (on the lower side as viewed in FIGS. 3 and 4). That is, the introducing portion 55 is arranged between the spark plug 33 and the intake manifold 31. The cylinder-head passage 50 has a plug-surrounding passage section 51 and an inter-exhaust-port passage section 52. The plug-surrounding passage section 51 surrounds an annular plug separating wall 23, which surrounds the spark plug 33. The inter-exhaust-port passage section 52 is located between two exhaust ports 22. The exhaust ports 22 are arranged in correspondence with the cylinder 123. The outer end of the inter-exhaust-port passage section 52 in the radial direction about the central axis 12*a* of the cylinder 123 communicates with the cylinder-block passage 16 via the communicating portion 60A. As a result, coolant flows inward in the aforementioned radial direction in the inter-exhaust-port passage section 52. The coolant then flows into the plug-surrounding passage section 51 after flowing through the inter-exhaust-port passage section 52. Specifically, the plug-surrounding passage section 51 is arranged immediately above the combustion chamber 14.

A restricting wall 24 is provided in the section of the cylinder-head passage 50 between the plug-surrounding passage section 51 and the introducing portion 55. One of the two intake ports 21 for the cylinder 123 that is closer to the introducing portion 55 in the cylinder arrangement direction X is defined as a predetermined intake port 21A. An intake-port separating wall 25 is a separating wall that separates the predetermined intake port 21A and the cylinder-head passage 50 from each other. The restricting wall 24 is set apart from the intake-port separating wall 25. Specifically, the restricting wall 24 is arranged at a position closer to the introducing portion 55 than the intake-port separating wall 25 in the cylinder arrangement direction X. Also, the restricting wall 24 is arranged at a position closer to the exhaust manifold 32 than the intake-port separating wall 25 in the predetermined direction Y (on the upper side, as viewed in FIGS. 3 and 4). This arrangement allows coolant communication between the restricting wall 24 and the intake-port separating wall 25.

One of the two exhaust ports 22 for the cylinder 123 that is closer to the introducing portion 55 in the cylinder arrangement direction X is defined as a predetermined exhaust port 22A. The restricting wall 24 is also set apart from an exhaust-port separating wall 26. The exhaust-port separating wall 26 is a separating wall that separates the predetermined exhaust port 22A and the cylinder-head passage 50 from each other. Specifically, the restricting wall 24 is arranged at a position closer to the introducing portion 55 than the exhaust-port separating wall 26 in the cylinder arrangement direction X. Also, the restricting wall 24 is arranged at a position closer to the intake manifold 31 than the exhaust-port separating wall 26 in the predetermined direction Y (on the lower side, as viewed in FIGS. 3 and 4). This arrangement allows coolant to flow between the restricting wall 24 and the exhaust-port separating wall 26.

Specifically, the distance between the restricting wall 24 and the intake-port separating wall 25 is substantially equal to the distance between the restricting wall 24 and the exhaust-port separating wall 26.

The cylinder-head passage 50 has outside-intake-port passage sections 53. The outside-intake-port passage sections 53 are located on the opposite side of the intake ports 21 to the plug-surrounding passage section 51. The outside-intake-port passage sections 53 include an outside-intake-port passage section 53A, which is located in the vicinity of the predetermined intake port 21A, which, in turn, is one of the two intake ports 21 for the cylinder 123. The outside-intake-port passage section 53A is connected to a passage zone 54, which is continuous with the introducing portion 55 in the cylinder-head passage 50.

Specifically, with reference to FIG. 3, coolant flows from the cylinder-block passage 16 into the upstream end of the outside-intake-port passage section 53A via the communicating portion 60B. Also, coolant flows from the cylinder-block passage 16, via the communicating portion 60C, to a position in the passage zone 54 closer to the intake manifold 31 than the restricting wall 24 in the predetermined direction Y (on the lower side as viewed in FIG. 3). That is, the communicating portions 60B, 60C correspond to the certain ones of the communicating portions. The certain ones of the communicating portions refer to some of the communicating portions 60 that are arranged at positions closer to the intake manifold 31 than the restricting wall 24 in the predetermined direction Y.

As shown in FIGS. 3 and 4, a section in the cylinder head 20 closer to the introducing portion 55 than the restricting wall 24 in the cylinder arrangement direction X is defined as a first end section 20A of the cylinder head 20. The in-cylinder-head EGR passage 42 is arranged in the first end section 20A. Specifically, the in-cylinder-head EGR passage 42 is located at a position farther outward than the cylinder-block passage 16 in the radial direction about the central axis 12*a* of the cylinder 123. Also, the in-cylinder-head EGR passage 42 is located at a position closer to the exhaust manifold 32 than the introducing portion 55 in the predetermined direction Y (on the upper side, as viewed in FIGS. 3 and 4). A passage separating wall 27, as a separating wall that separates the cylinder-head passage 50 and the in-cylinder-head EGR passage 42 from each other, is thus arranged at a position closer to the exhaust manifold 32 than the introducing portion 55 in the predetermined direction Y. A passage restricting portion 28 is arranged at a position closer to the introducing portion 55 than the restricting wall 24 in the cylinder arrangement direction X and between the introducing portion 55 and the passage separating wall 27 in the predetermined direction Y. The passage restricting portion 28 is configured to decrease the width of the cylinder-head passage 50 in the extending direction of the central axis 12*a* of the cylinder 123.

Figure 5:
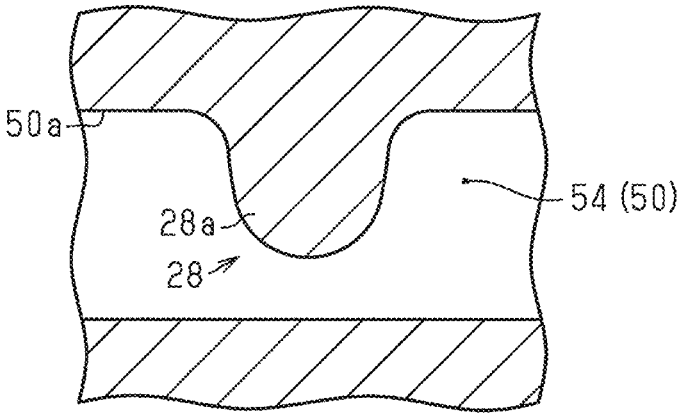
FIG. 5 is a cross-sectional view as taken along line 5-5 in FIG. 4, showing the cylinder head.

Specifically, as shown in FIG. 5, the passage restricting portion 28 is configured by a projection 28*a*. The projection 28*a* projects from a section of a peripheral wall 50*a* of the cylinder-head passage 50 located on the opposite side to the cylinder block 11 (from the upper surface as viewed in FIG. 5) toward the cylinder block 11 (toward the lower side as viewed in the drawing). The distal end of the projection 28*a* does not contact a section of the peripheral wall 50*a* of the cylinder-head passage 50 corresponding to the cylinder block 11.

An operation and advantages of the present embodiment will now be described.

Coolant flows into the cylinder-head passage 50 via the communicating portions 60B, 60C. The coolant then flows in the cylinder-head passage 50 as represented by the broken arrows in FIG. 6. That is, the coolant flows toward the section between the intake-port separating wall 25 and the restricting wall 24, toward the introducing portion 55, and toward the passage separating wall 27.

Figure 6:
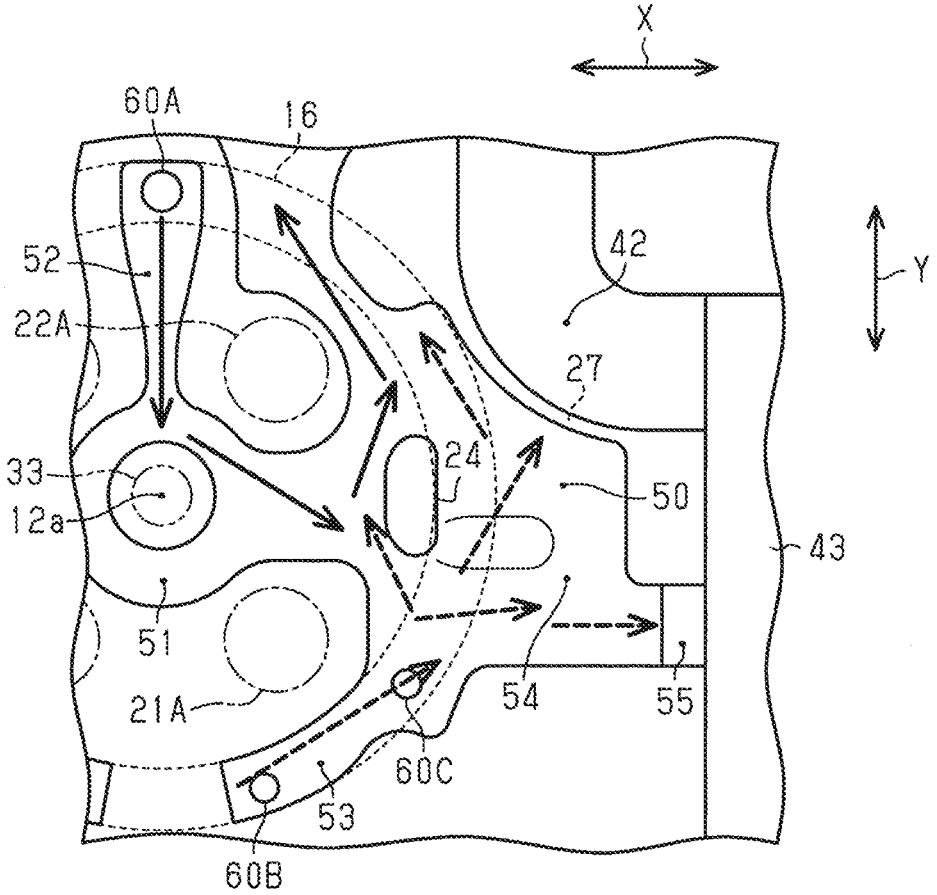
FIG. 6 is a diagram illustrating coolant flows in the cylinder head.

Coolant also flows into the cylinder-head passage 50 via the communicating portion 60A. The coolant flows in the cylinder-head passage 50 as represented by the solid arrows in FIG. 6. That is, the coolant flows inward in the aforementioned radial direction in the inter-exhaust-port passage section 52 and then into the plug-surrounding passage section 51. Referring to FIG. 3, the plug-surrounding passage section 51 is located immediately above the combustion chamber 14 in the cylinder 123. This facilitates heat transfer from the combustion chamber 14 to the coolant in the plug-surrounding passage section 51. The temperature of the coolant in the plug-surrounding passage section 51 thus becomes higher than the temperature of the coolant that does not pass through the plug-surrounding passage section 51. Some of the comparatively high-temperature coolant in the plug-surrounding passage section 51 flows toward the introducing portion 55, as illustrated in FIG. 6.

As discussed above, the restricting wall 24 is provided between the plug-surrounding passage section 51 and the introducing portion 55. The restricting wall 24 thus restricts the flow of the coolant from the plug-surrounding passage section 51 toward the introducing portion 55. This limits the introduction, to the introducing portion 55, of the comparatively high-temperature coolant that has received heat from the combustion chamber 14. On the other hand, correspondingly facilitated is the introduction of the coolant that has flowed into the cylinder-head passage 50 via the communicating portions 60B, 60C, that is, the comparatively low-temperature coolant that has received only a limited amount of heat from the combustion chamber 14, to the introducing portion 55. As a result, the reduction of the cooling efficiency of EGR gas used in the EGR cooler 43 may be limited.

A clearance exists between the restricting wall 24 and the intake-port separating wall 25. This causes the comparatively high-temperature coolant in the plug-surrounding passage section 51 to flow toward the introducing portion 55 via the clearance. However, the flow of the comparatively high-temperature coolant is limited by the comparatively low-temperature coolant that has flowed into the cylinder-head passage 50 via the communicating portions 60B, 60C. As a result, as represented by the solid arrows in FIG. 5, the comparatively high-temperature coolant in the plug-surrounding passage section 51 flows out of the plug-surrounding passage section 51 via the section between the restricting wall 24 and the exhaust-port separating wall 26.

Specifically, some of the comparatively low-temperature coolant that has flowed to the clearance between the restricting wall 24 and the intake-port separating wall 25 flows toward the plug-surrounding passage section 51 via the clearance. By causing the comparatively low-temperature coolant to flow into the plug-surrounding passage section 51 in this manner, the cooling efficiency of the combustion chamber 14 using coolant may be improved.

Embodiments may further have the following features.

(1) The introducing portion 55 is arranged at a position closer to the communicating portions 60B, 60C than the restricting wall 24 in the predetermined direction Y. The distance from each communicating portion 60B, 60C to the introducing portion 55 thus becomes comparatively small. This limits increase in the amount of heat received by coolant after the coolant flows into the cylinder-head passage 50 via the communicating portions 60B, 60C until the coolant reaches the introducing portion 55. That is, the temperature rise is limited in the coolant introduced into the EGR cooler 43, thus the cooling efficiency of EGR gas used in the EGR cooler 43 may be improved.

(2) In the first end section 20A of the cylinder head 20, the cylinder-head passage 50 and the in-cylinder-head EGR passage 42 are adjacent to each other with the passage separating wall 27 located between the cylinder-head passage 50 and the in-cylinder-head EGR passage 42. Therefore, the coolant that flows in the vicinity of the passage separating wall 27 in the cylinder-head passage 50 cools the EGR gas that flows in the in-cylinder-head EGR passage 42. This further lowers the temperature of the EGR gas that is recirculated into an intake pipe.

Specifically, the in-cylinder-head EGR passage 42 is arranged at a position closer to the exhaust manifold 32 than the introducing portion 55 in the predetermined direction Y. This hampers the introduction, to the introducing portion 55, of the coolant that has received heat from the EGR gas flowing in the in-cylinder-head EGR passage 42. As a result, a temperature rise is restrained in the coolant that is introduced into the EGR cooler 43 via the introducing portion 55.

(3) The passage restricting portion 28 is arranged between the communicating portions 60B, 60C and the passage separating wall 27 in the predetermined direction Y. The passage restricting portion 28 decreases the cross-sectional flow area of the corresponding section in the cylinder-head passage 50. The coolant that has flowed into the cylinder-head passage 50 via the communicating portions 60B, 60C passes through this section while flowing toward the passage separating wall 27. This increases the flow velocity of the coolant. In this manner, the coolant that has flowed into the cylinder-head passage 50 via the communicating portions 60B, 60C readily reaches the vicinity of the passage separating wall 27. This ensures a coolant flow in the vicinity of the passage separating wall 27, thus limiting the reduction of the cooling efficiency of the EGR gas that flows in the in-cylinder-head EGR passage 42.

The above-described embodiments may be modified as follows. The above-described embodiments and the following modifications can be combined as long as the combined modifications remain technically consistent with each other.

The passage restricting portion 28 may be configured by a projection that is provided in a section of the peripheral wall 50*a* of the cylinder-head passage 50 opposed to the cylinder block 11 and projects toward the opposite side to the cylinder block 11.

Alternatively, the passage restricting portion 28 may be configured by two projections. One of the projections is provided in a section of the peripheral wall 50*a* of the cylinder-head passage 50 opposed to the cylinder block 11 and projects toward the opposite side to the cylinder block 11. The other one of the projections is provided in a section of the peripheral wall 50*a* of the cylinder-head passage 50 that is located on the opposite side to the cylinder block 11 and projects toward the cylinder block 11.

The passage restricting portion 28 may be omitted if the coolant that has flowed into the cylinder-head passage 50 via the communicating portions 60B, 60C is allowed to flow to the vicinity of the passage separating wall 27 without increasing the flow velocity of the coolant by way of the passage restricting portion 28.

The flow path of the EGR gas may be configured such that the EGR gas flows from the exhaust manifold 32 to the EGR cooler 43 without passing through the interior of the cylinder head 20.

If the introducing portion 55 is located on the opposite side of the restricting wall 24 to the spark plug 33 in the cylinder arrangement direction X, the introducing portion 55 does not necessarily have to be arranged at a position closer to the intake manifold 31 than the restricting wall 24 in the predetermined direction Y. The introducing portion 55 may be arranged at, for example, the position corresponding to the restricting wall 24 in the predetermined direction Y.

In the illustrated embodiments, the distance between the restricting wall 24 and the intake-port separating wall 25 is substantially equal to the distance between the restricting wall 24 and the exhaust-port separating wall 26. However, embodiments are not restricted to this. The distance between the restricting wall 24 and the intake-port separating wall 25 may be unequal to the distance between the restricting wall 24 and the exhaust-port separating wall 26. For example, the distance between the restricting wall 24 and the intake-port separating wall 25 may be greater than the distance between the restricting wall 24 and the exhaust-port separating wall 26.

Alternatively, the distance between the restricting wall 24 and the intake-port separating wall 25 may be smaller than the distance between the restricting wall 24 and the exhaust-port separating wall 26. Such a small distance between the restricting wall 24 and the intake-port separating wall 25 may enhance the effect of limiting the flow of comparatively high-temperature coolant from the plug-surrounding passage section 51 to the introducing portion 55.

If the restricting wall 24 is set apart from the intake-port separating wall 25, a section of the restricting wall 24 may be located at a position corresponding to the intake-port separating wall 25 in the cylinder arrangement direction X.

The restricting wall 24 may be adjacent to the intake-port separating wall 25.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An internal combustion engine, comprising:

a cylinder block;

a cylinder-block passage provided in the cylinder block;

a cylinder head;

a cylinder-head passage provided in the cylinder head and configured such that coolant flows into the cylinder-head passage after circulating in the cylinder-block passage;

cylinders arranged side-by-side in the cylinder block;

an introducing portion, wherein a direction in which the cylinders are arranged side-by-side is a cylinder arrangement direction, and the introducing portion is provided at an end of the cylinder head in the cylinder arrangement direction and configured to introduce the coolant flowing in the cylinder-head passage into an EGR cooler;

a restricting wall, wherein one of the cylinders closest to the introducing portion in the cylinder arrangement direction is a predetermined cylinder, and the restricting wall is provided between a spark plug provided for the predetermined cylinder and the introducing portion in the cylinder-head passage and is configured to restrict flow of the coolant from a section corresponding to the spark plug toward the introducing portion; and communicating portions arranged at corresponding positions in a flow direction of the coolant in the cylinder-block passage to cause the cylinder-block passage and the cylinder-head passage to communicate with each other, wherein a direction perpendicular to both an extending direction of a central axis of each of the cylinders and the cylinder arrangement direction is defined as a first direction, and one or more of the communicating portions are arranged at positions closer to an intake manifold than the restricting wall in the first direction.

2. The engine according to claim 1, further comprising intake ports arranged in the cylinder head, wherein one of the intake ports located closest to the introducing portion in the cylinder arrangement direction is defined as a predetermined intake port, the engine further comprises an intake-port separating wall that separates the predetermined intake port and the cylinder-head passage from each other, and the restricting wall is set apart from the intake-port separating wall.

3. The engine according to claim 1, wherein the introducing portion is arranged at a position closer to the intake manifold than the restricting wall in the first direction.

4. The engine according to claim 3, wherein a section of the cylinder head closer to the introducing portion than the restricting wall in the cylinder arrangement direction is a first end, and the engine further comprises:

an EGR passage section arranged in the first end section of the cylinder head and configured such that EGR gas flows toward the EGR cooler through the EGR passage section; and a passage separating wall arranged in a section of the cylinder head closer to an exhaust manifold than the introducing portion in the first direction, the passage separating wall being a separating wall that separates the cylinder-head passage and the EGR passage section from each other.

5. The engine according to claim 4, further comprising a passage restricting portion arranged in a section closer to the introducing portion than the restricting wall in the cylinder arrangement direction and between the introducing portion and the passage separating wall in the first direction, the restricting portion being configured to decrease a width of the cylinder-head passage in the extending direction of the central axis of the corresponding cylinder.

6. The engine according to claim 5, wherein the passage restricting portion is a projection projecting toward the cylinder block from a section of a peripheral wall of the cylinder-head passage located on a side opposite to the cylinder block.

* * * * *